US009905905B1

(12) United States Patent
Burrell et al.

(10) Patent No.: US 9,905,905 B1
(45) Date of Patent: Feb. 27, 2018

(54) ANTENNA ENCLOSURE FOR ATTACHMENT TO A HANDRAIL

(71) Applicant: TESSCO Communications Incorporated, Hunt Valley, MD (US)

(72) Inventors: Dennis Burrell, Austin, TX (US); Timothy Ortel, Timonium, MD (US)

(73) Assignee: TESSCO COMMUNICATIONS INCORPORATED, Hunt Valley, MD (US)

( * ) Notice: Subject to any disclaimer, the term of this patent is extended or adjusted under 35 U.S.C. 154(b) by 0 days.

(21) Appl. No.: 14/859,936

(22) Filed: Sep. 21, 2015

Related U.S. Application Data

(60) Provisional application No. 62/056,044, filed on Sep. 26, 2014.

(51) Int. Cl.
*H01Q 1/12* (2006.01)
*H01Q 9/34* (2006.01)

(52) U.S. Cl.
CPC ..... *H01Q 1/12* (2013.01); *H01Q 9/34* (2013.01)

(58) Field of Classification Search
CPC .. H01Q 1/10; H01Q 1/12; H01Q 9/34; H01Q 1/1242; E04H 12/00
USPC ..... 248/161, 201, 218.4, 219.3, 519; 343/872, 892
See application file for complete search history.

(56) References Cited

U.S. PATENT DOCUMENTS 4,138,953 A * 2/1979 Tashman ..... A47B 57/265 108/147.13
4,318,352 A * 3/1982 Friedman ..... A47B 57/265 108/107
4,728,962 A * 3/1988 Kitsuda ..... H01Q 1/38 343/700 MS
5,926,151 A * 7/1999 Hagiwara ..... H01Q 1/125 343/757
6,175,339 B1 * 1/2001 Macon ..... H01Q 1/1221 343/878
6,450,462 B1 * 9/2002 Hsieh ..... G10D 13/026 248/125.1
7,068,238 B2 6/2006 Yoneya et al.
7,187,333 B2 3/2007 Yoneya et al.
D550,217 S * 9/2007 Schneider ..... D14/230
7,339,538 B2 3/2008 Yoneya et al.
7,567,214 B2 * 7/2009 Takisawa ..... H01Q 1/1221 343/700 MS
7,586,459 B2 9/2009 Noro et al.
8,179,326 B2 5/2012 Chang
8,264,420 B2 9/2012 Sato et al.
(Continued)

*Primary Examiner* — Muhammad Ijaz
(74) *Attorney, Agent, or Firm* — Shlesinger, Arkwright & Garvey LLP

(57) ABSTRACT

An antenna enclosure for attachment to a handrail, comprises a first part and a second part, the first and second parts being configured to mate together to form said enclosure; each of the first and second parts including a cavity portion having a base wall, a peripheral external side wall and an inner wall; the external side wall of the first part is configured to mate with the external side wall of the second part; a seal disposed between the external side wall of the first part and the external side wall of the second part; and the first and second parts including respective clamp portions configured to wrap around a post of the handrail when the first and second parts are mated together.

21 Claims, 7 Drawing Sheets

(56) References Cited

U.S. PATENT DOCUMENTS

| | | | | |
|---|---|---|---|---|
| 8,305,289 | B2 * | 11/2012 | Lo | H01Q 1/125 343/890 |
| 8,462,075 | B2 | 6/2013 | Lettkeman | |
| 8,780,004 | B1 * | 7/2014 | Chin | H01Q 1/526 343/841 |
| 2002/0003504 | A1 * | 1/2002 | Yoshida | H01Q 1/1207 343/892 |
| 2005/0059428 | A1 * | 3/2005 | Tung | A45B 3/00 455/556.1 |
| 2008/0169996 | A1 | 7/2008 | Yang | |
| 2009/0137155 | A1 * | 5/2009 | Yeh | B60R 11/0235 439/626 |
| 2011/0168855 | A1 * | 7/2011 | Bonczyk | H01Q 1/1207 248/201 |
| 2011/0303712 | A1 * | 12/2011 | Calamia | A63C 11/02 224/401 |
| 2014/0049057 | A1 * | 2/2014 | Brandt | B65D 45/345 292/256.69 |
| 2015/0181645 | A1 * | 6/2015 | Anderson | H01Q 1/22 361/814 |
| 2015/0280307 | A1 * | 10/2015 | Lin | H01Q 1/1264 248/230.5 |

* cited by examiner

ANTENNA ENCLOSURE FOR ATTACHMENT TO A HANDRAIL

RELATED APPLICATION

This is a nonprovisional application claiming the priority benefit of provisional application Ser. No. 62/056,044, filed Sep. 26, 2014, hereby incorporated by reference.

FIELD OF THE INVENTION

The present invention is generally directed to antenna enclosures and in particular to antenna enclosures for attachment to a handrail or the like in an environment where the utilization of rails (pipe, poles, etc.) as the mounting solution to secure the antenna is necessary.

BACKGROUND OF THE INVENTION

In locations such as stadiums and arenas and the like, a paramount importance has been placed on providing wireless connectivity to attendees attending the events being conducted in the facilities. The architectural designs of these venues limit the options to mount antennas to provide wireless connectivity to the consumers attending an event.

SUMMARY OF THE INVENTION

The present invention provides an antenna enclosure for attachment to a handrail, comprising a first part and a second part, the first and second parts being configured to mate together to form said enclosure; each of the first and second parts including a cavity portion having a base wall, a peripheral external side wall and an inner wall; the external side wall of the first part is configured to mate with the external side wall of the second part; a seal disposed between the external side wall of the first part and the external side wall of the second part; and the first and second parts including respective clamp portions configured to wrap around a post of the handrail when the first and second parts are mated together.

BRIEF DESCRIPTION OF THE DRAWINGS

FIG. 11 is a perspective of a standard handrail attached to a set of stairs used in a stadium or the like.

DETAILED DESCRIPTION OF THE INVENTION

Figure 1:
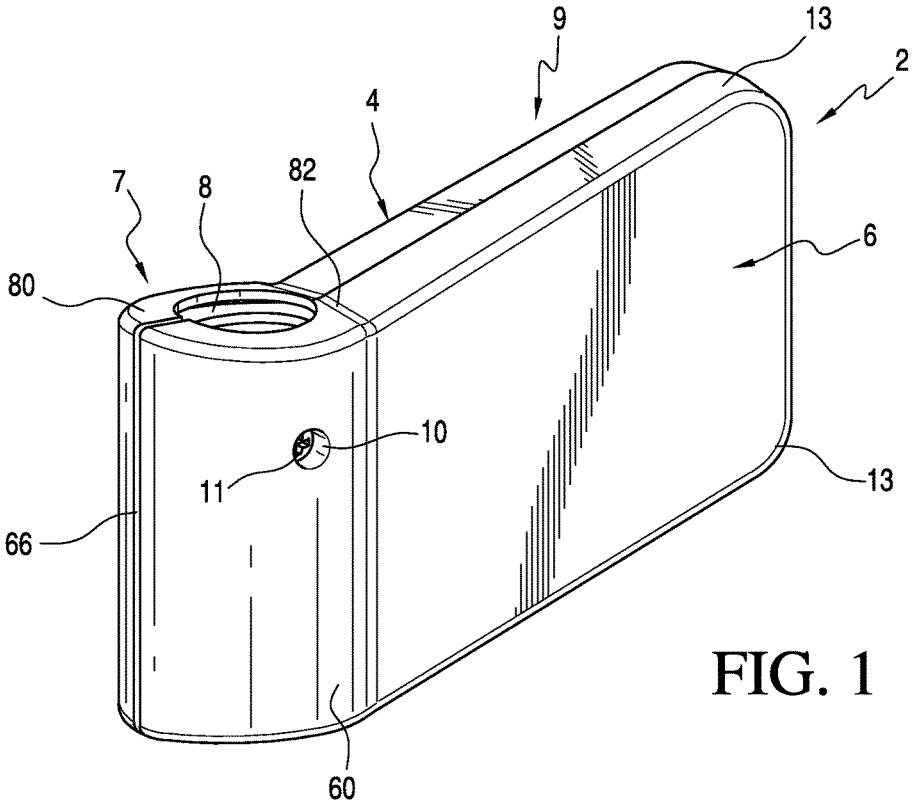
FIG. 1 is a right side perspective view of an antenna enclosure made in accordance with the present invention.
Figure 2:
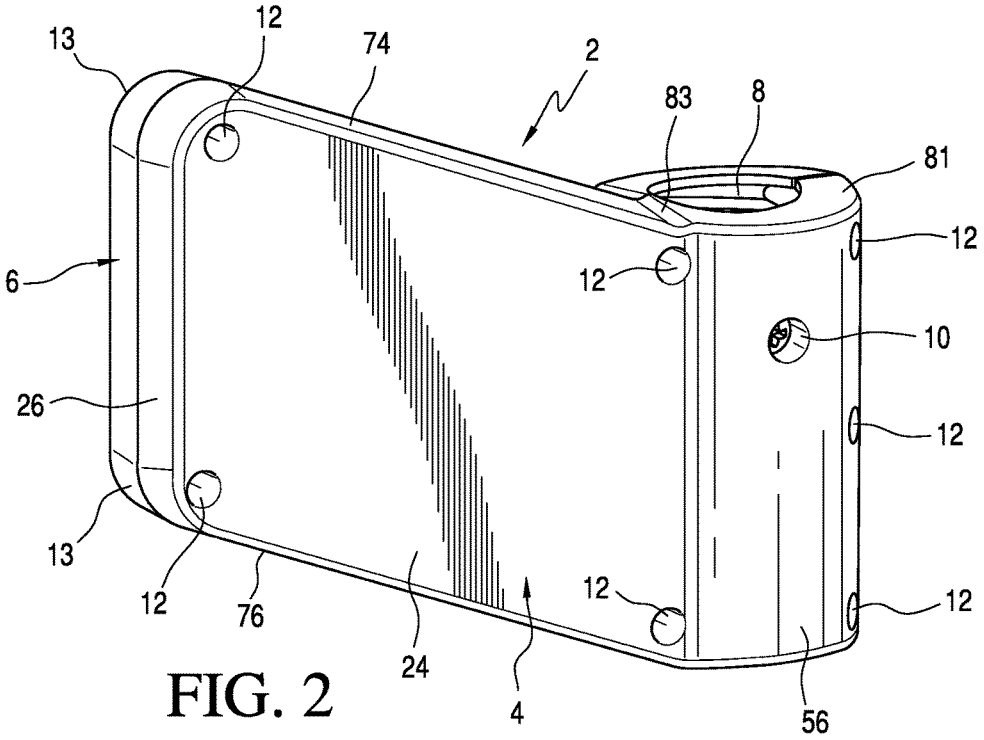
FIG. 2 is a left side perspective view of the antenna enclosure shown in FIG. 1.

Referring to FIGS. 1 and 2, an antenna enclosure 2 comprises a first part 4 and a second part 6 configured to mate together to form the enclosure 2. The first part 4 and the second part 6 are hollow and each may be made in the form of half shells. The enclosure 2 includes an attachment portion 7 including a vertically disposed opening 8 for receiving a portion of a pipe, such the post portion of a handrail. The enclosure 2 also includes a housing portion 9 for receiving within the antenna. The housing portion 9 includes rounded corners 13 to advantageously prevent inadvertent snagging by the persons using the handrail. The enclosure 2 may be made of any material, such as plastic or metal, that would be suitable for outdoor use.

The first part 4 and the second part 6 are mounted on the handrail post in a clamping fashion as the attachment portion 7 fits around the post.

The attachment portion 7 is preferably disposed vertically when attached to the post. The housing portion 9 is advantageously disposed inclined upwardly from the attachment portion 7 to divert water that might enter the housing portion 9 away from the antenna.

Countersunk holes 10 are provided for attachment screws for attaching the enclosure 2 to the post. The attachment screws 11 advantageously provide anti-rotation to the enclosure 2 and further provide extra strength to handle abuse. Other countersunk holes 12 are provided for attaching the first part 4 to the second part 6. The holes 10 and 12 are advantageously countersunk to prevent the heads of the attaching screws from snagging the hands or clothing of people using the handrail.

Figure 3:
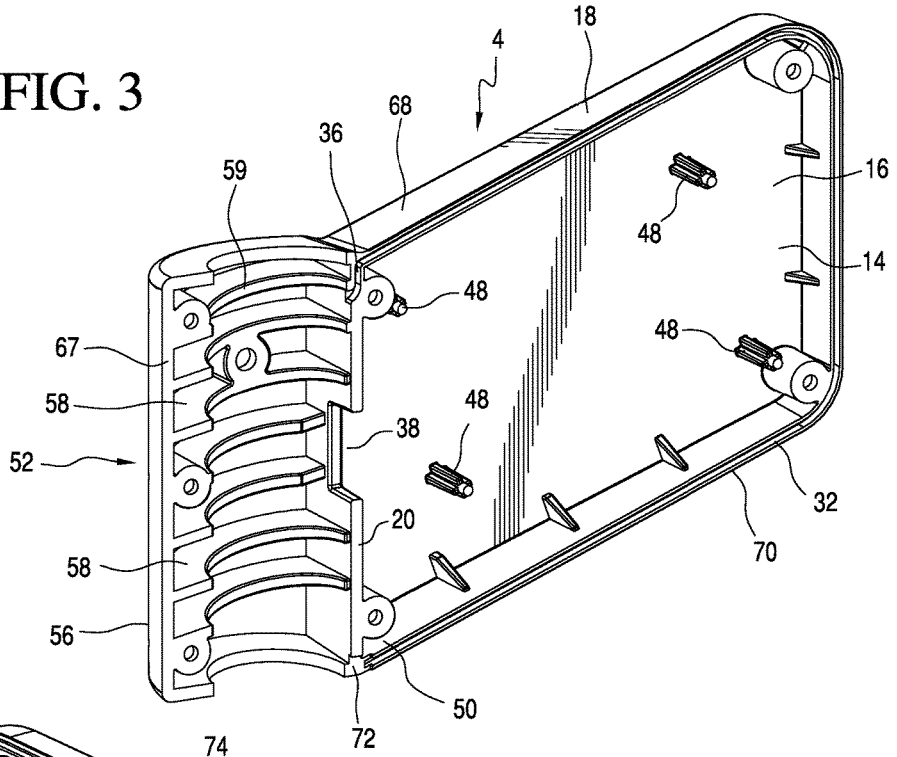
FIG. 3 is a perspective view of the left side of the antenna enclosure, with the right side removed.
Figure 4:
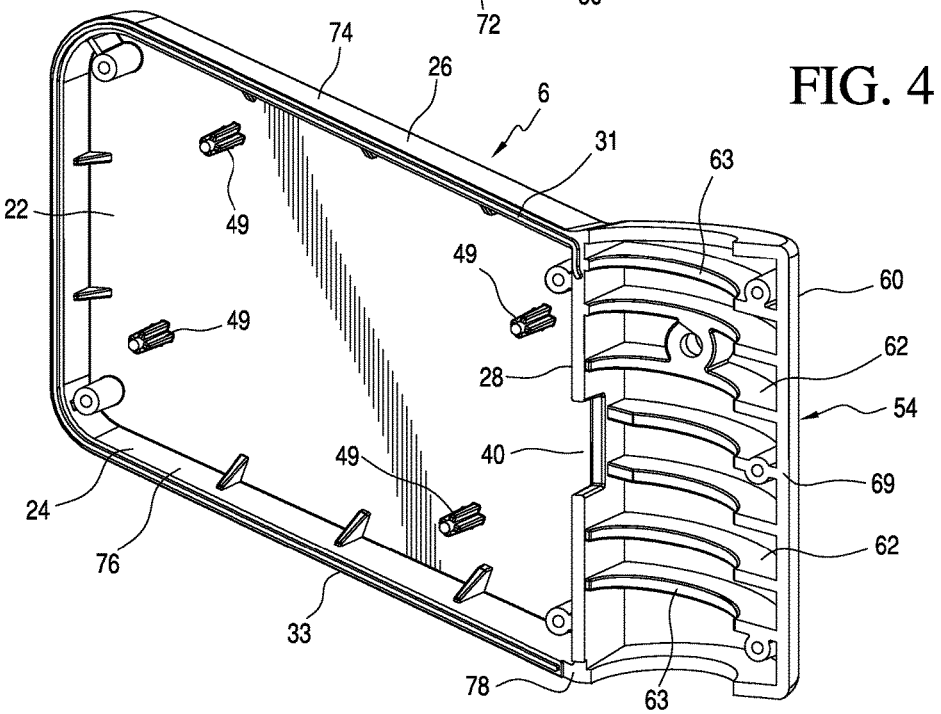
FIG. 4 is a perspective view of the right side of the antenna enclosure, with the left side removed.
Figure 5:
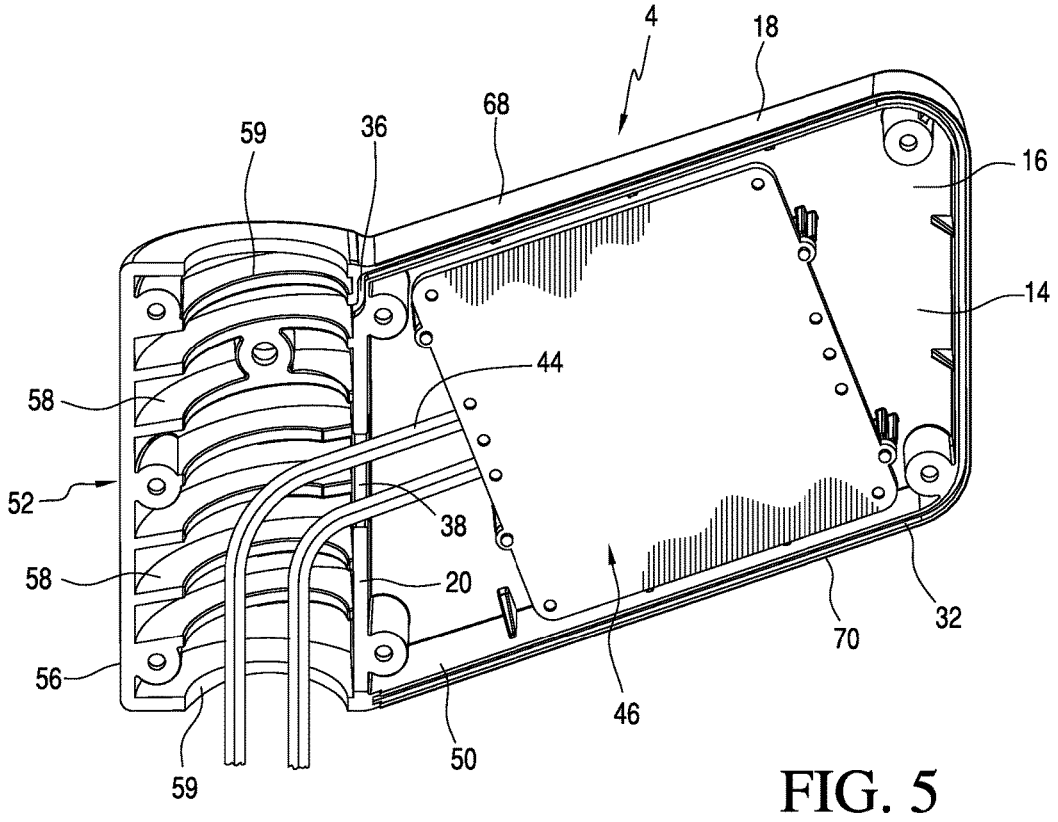
FIG. 5 is a perspective view of the left side of the antenna enclosure, with the right side removed, showing an antenna disposed within.

Referring to FIGS. 3, 4 and 5, the first part 4 is shown separated from the second part 6. The first part 4 includes a cavity 14 bounded by a base wall 16, an external side wall 18 and an internal side wall 20. Similarly, the second part 6 includes a cavity 22 bounded by a base wall 24, an external side walls 26 and an internal side wall 28. The cavity 22 is preferably a mirror image of the cavity 14. Similarly, the base wall 24, the external side wall 26 and the internal side wall 28 are preferably mirror images of the external side wall 18 and internal side wall 20. The cavities 14 and 22 form the housing portion 9 when the first part 4 and the second part 6 are mated together.

Figure 6:
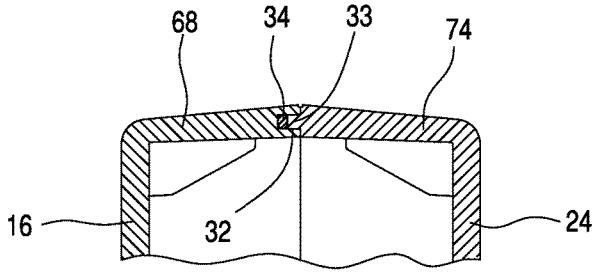
FIG. 6 is a cross-sectional view taken along line 6-6 in FIG. 8.

Referring to FIG. 6, the external side walls 18 and 26 have opposing edges 30 and 31 provided with a groove 32 on the edge 30 and a bead 33 on the edge 31. A seal 34 is disposed inside the groove 32. The bead 33 is configured to be received within the groove 32 and compress the seal 34 when the first part 4 is mated to the second part 6, thereby providing a sealing joint between the opposing edges 30 and 31.

Referring to FIG. 3, a leading portion 36 of the seal 34 is disposed at an upper portion of the internal side wall 20. The leading portion 36 is disposed to direct any water that might get inside the sealing joint away from the cavities 14 and 22 and toward the attachment portion 7 where it is then directed to the outside, as will be seen below.

Figure 8:
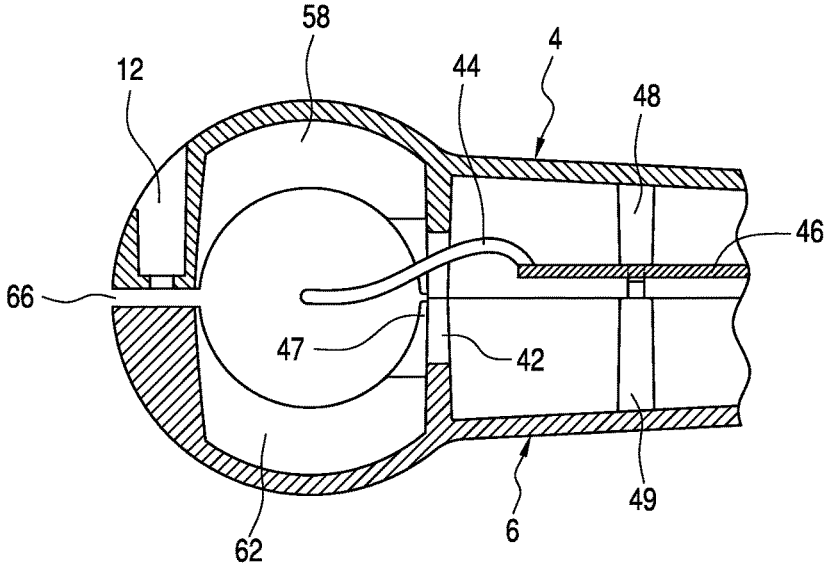
FIG. 8 is a cross-sectional view taken along line 8-8 of FIG. 9.

The internal side wall 20 of the part 4 includes a slot 38. The internal side wall 28 of the part 6 similarly has a slot 40, which is preferably a mirror image of the slot 38. The slots 38 and 40 form an opening 42 (see FIG. 8) when the first part 4 and the second part 6 are mated together. The opening 40 is preferably square to introduce discontinuities at the corners to water flow to divert the water from the cavities 14 and 22. The opening 40 is sized to accommodate the cables 44 from the antenna 46, as shown in FIG. 5. The side walls 20 and 28 are preferably spaced from the post by a distance 47 (see FIGS. 8 and 12), thus keeping the opening 42 spaced from the post to minimize water from the post from entering into the housing portion 9.

The respective cavities 14 and 22 form a chamber in which the antenna 46 is disposed when the first part 4 and the second part 6 are mated together.

The first part 4 and the second part 6 include antenna mounting posts 48 and 49 extending transversely from the respective base walls 16 and 24. The posts 48 and 49 are preferably used to position and secure the antenna 46 within the cavities 14 and 22, preferably in spaced relation from the base walls 16 and 24. The antenna 46 is advantageously positioned within the cavity 14 at a higher position than the lowest bottom portion 50 of the cavity 14 to advantageously keep the antenna away from any water that might accumulate within the cavity 14. The posts 48 and 49 are aligned to each other when the first part 4 and the second part 6 are mated together. The cables 44 are advantageously positioned through the slots 38 and 40 downwardly at an angle from above to prevent water that might catch on the cables from traveling toward the antenna 46.

Referring to FIGS. 3 and 4, the first part 4 includes a clamp portion 52. The second part 6 also includes a clamp portion 54, which is substantially a mirror image of the clamp portion 52. The clamp portions 52 and 54 are configured to clamp around the post when the first part 4 and the second part 6 are mated together.

The clamp portion 52 includes a base wall 56, which is preferably semi-circular in cross-section. A plurality of rib portions 58 spaced apart from each other extend transversely from the base wall 56. The rib portions 58 are advantageously oriented downwardly away from the cavity 14 to direct water that might get inside the clamp portion 52 away from the antenna 46. The rib portions 58 include edges 59 that are preferably shaped to fit around and engage the external surface of the post. For a round post as shown, the edges 59 are preferably semi-circular.

Referring to FIG. 4, the clamp portion 54 in the second part 6 also includes a base wall 60 and rib portions 62 extending transversely from the base wall 60. The rib portions 62 include edges 63 that are preferably shaped to fit around and engage the external surface of the post. For a round post as shown, the edges 63 are preferably semi-circular.

Figure 9:
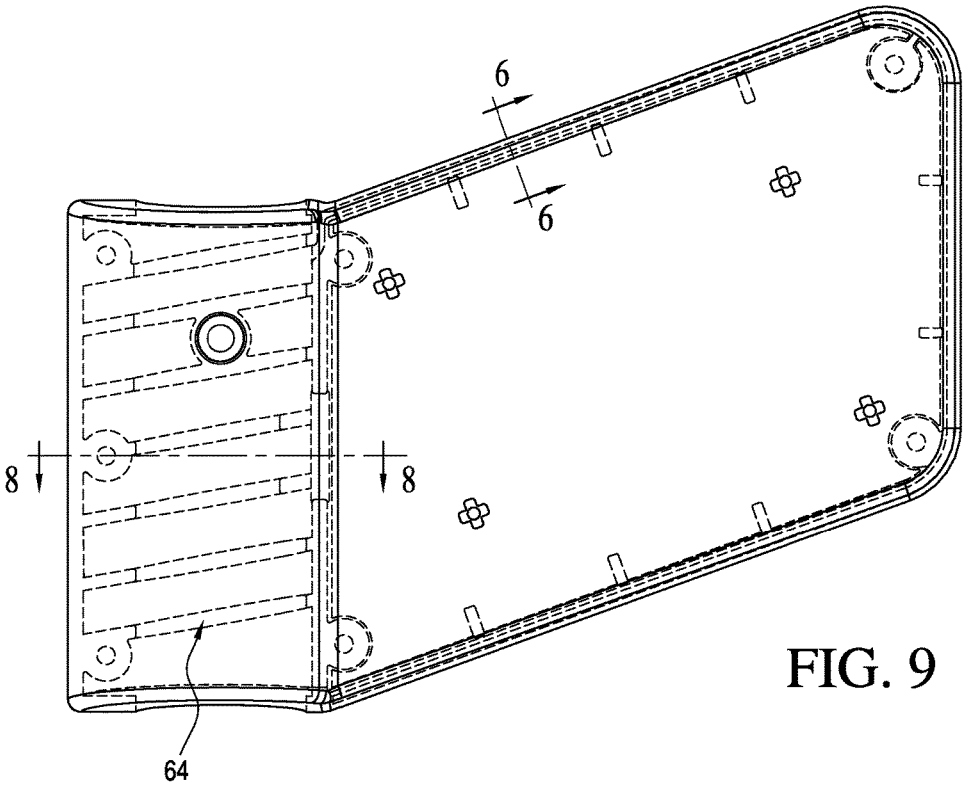
FIG. 9 is a side elevational view of FIG. 1, showing the downwardly inclined ribs.

The rib portions 58 and 62 together form a spiral rib 64 (see FIG. 9) that advantageously drains any water that might get within the clamp portions 52 and 54 through a gap 66 (see FIG. 8) between the opposing edges 67 and 69 of the base walls 56 and 60 of the clamp portions 52 and 54. The gap 66 also advantageously ensures that a positive clamping force to the pipe is applied when the clamp portions 52 and 54 are tightened around the pipe.

Referring to FIG. 3, the external side wall 18 includes a top wall 68 and a bottom wall 70. The top and bottom walls 68 and 70 are preferably parallel to each other and advantageously inclined downwardly toward the post so that any water that might collect within cavity 14 will flow by gravity toward a notch 72 at the bottom corner of the internal side wall 20 and bottom wall 70.

Referring to FIG. 4, the external side wall 26 includes a top wall portion 74 and a bottom wall 76. The top and bottom walls 74 and 76 are preferably parallel to each other and advantageously inclined downwardly toward the post so that any water that might collect within cavity 22 will flow by gravity toward a notch 78 at the bottom corner of the internal side wall 28 and the bottom wall 76.

The notches 72 and 78 define a drain hole when the first part 4 and the second part 6 are mated together.

The top wall walls 68 and 74 are preferably ramped downwardly away from each other along their opposing edges 30 and 31 to advantageously drain water away from the joint between the edges 30 31 when the first part 4 and the second part 6 are mated together.

The clamp portions 52 and 54 include top walls 80 and 81 that are advantageously ramped downwardly away from the post to direct any water away from the junction between the post and the attachment portion 7. The top walls 80 and 81 advantageously meet with the bottom portions of the top walls 68 and 74 in rain gutters 82 and 83 disposed transversely and downwardly from the edges 30 and 31.

The antenna mounting posts 48 and 49 project transversely from the respective base walls 16 and 24 within the respective cavities 14 and 22 to securely attach the antenna 46 within the housing portion 9. The mounting posts 48 are configured to dispose the antenna 46 at a higher elevation within the cavities 14 and 22 such that the antenna will be protected from any water that might get inside the cavities 14 and 22.

Figure 7:
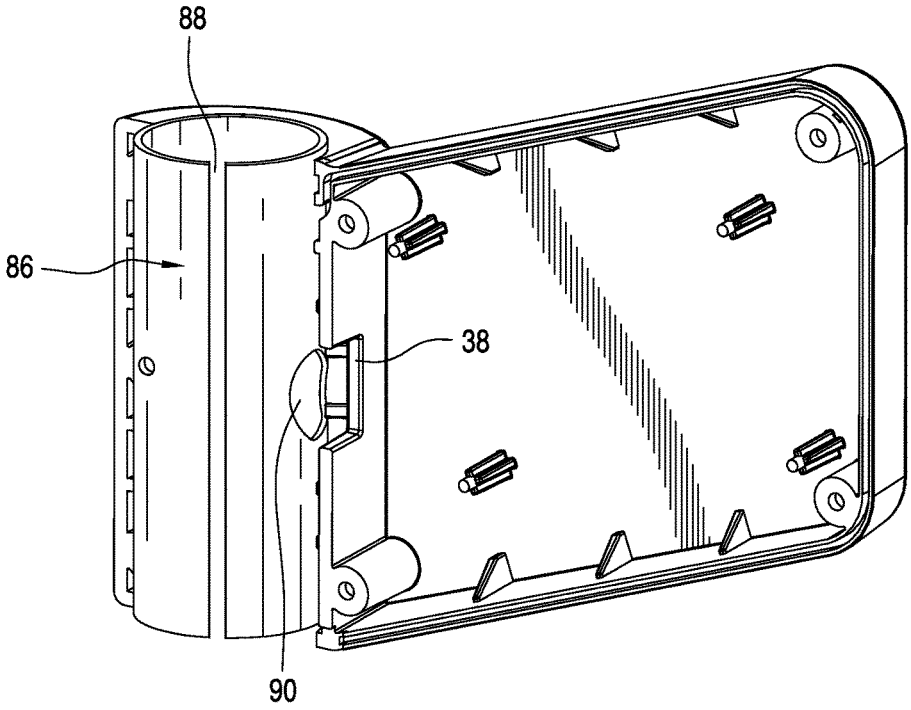
FIG. 7 is a perspective view of the left side of the antenna enclosure, with the right side removed, showing a sleeve spacer for use for a smaller pipe diameter.

Referring to FIG. 7, a spacer sleeve 86 may be used for posts having a smaller outside diameter than the diameter of the opening 8. The sleeve 86 includes a longitudinal slit 88 to permit placement of the sleeve 86 around the post. An opening 90 is advantageously aligned with the slots 38 and 40 to allow the cables 44 to pass to the inside of the post. The sleeve 86 may be made of flexible material, such as rubber.

Figure 10:
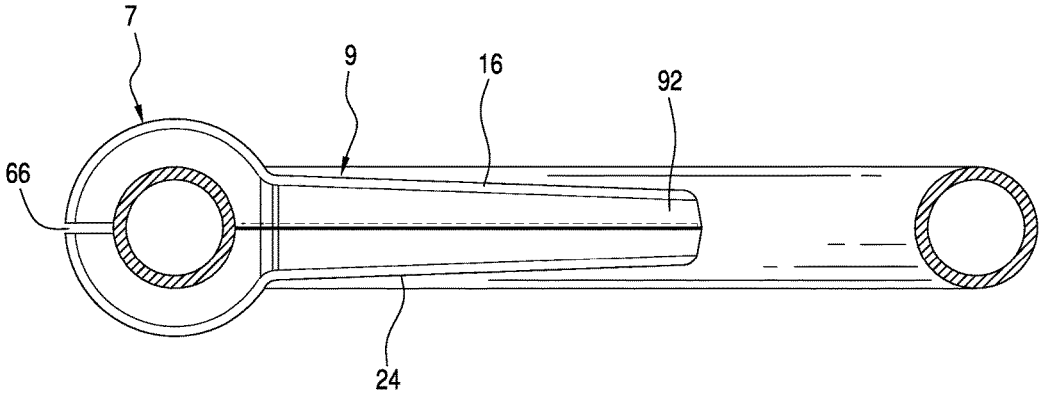
FIG. 10 is a cross-sectional view taken along line 10-10 in FIG. 11.

Referring to FIG. 10, the housing portion 9 is preferably tapered from narrow to wide toward the post. The base walls 16 and 24 make a small angle between them when the first part 4 and the second part 6 are mated together to provide the tapered shape of the housing portion 9. The tapered shape is advantageously configured such that at least the narrow portion 92 of the housing portion 9 is narrower than the outside diameter of the handrail. In this manner, users of the handrail will minimize inadvertent snagging of their clothing or bodies against the housing portion 9.

Figure 11:
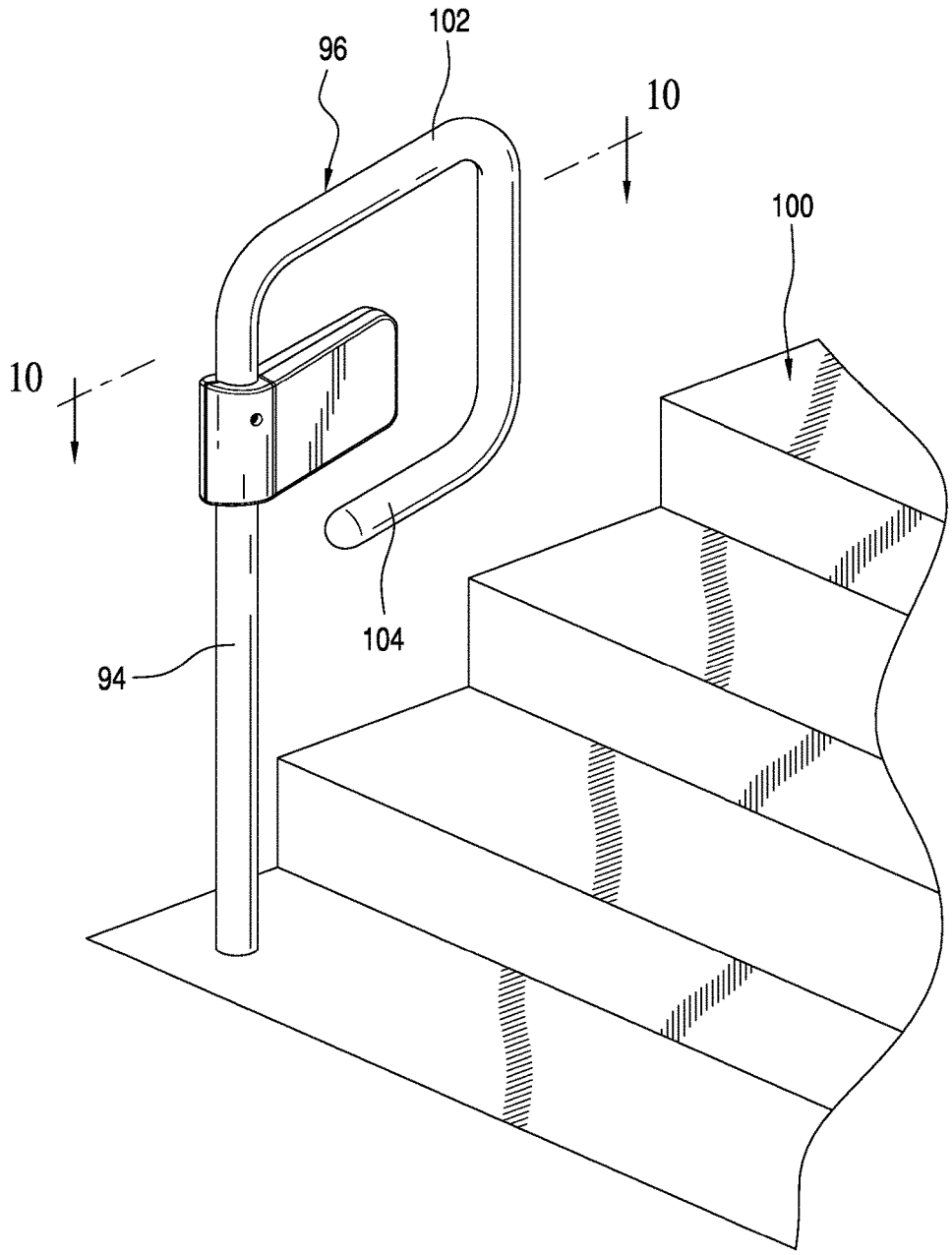

Referring to FIG. 11, the enclosure 2 is shown attached to a handrail 96, which is used with a set of stairs 100. The housing portion 9 is advantageously angled to provide clearance between the upper and lower handrail portions 102 and 104. The enclosure 2 may also be installed to any tubular post of a structure typically used around people attending an event in a stadium or arena.

Figure 12:
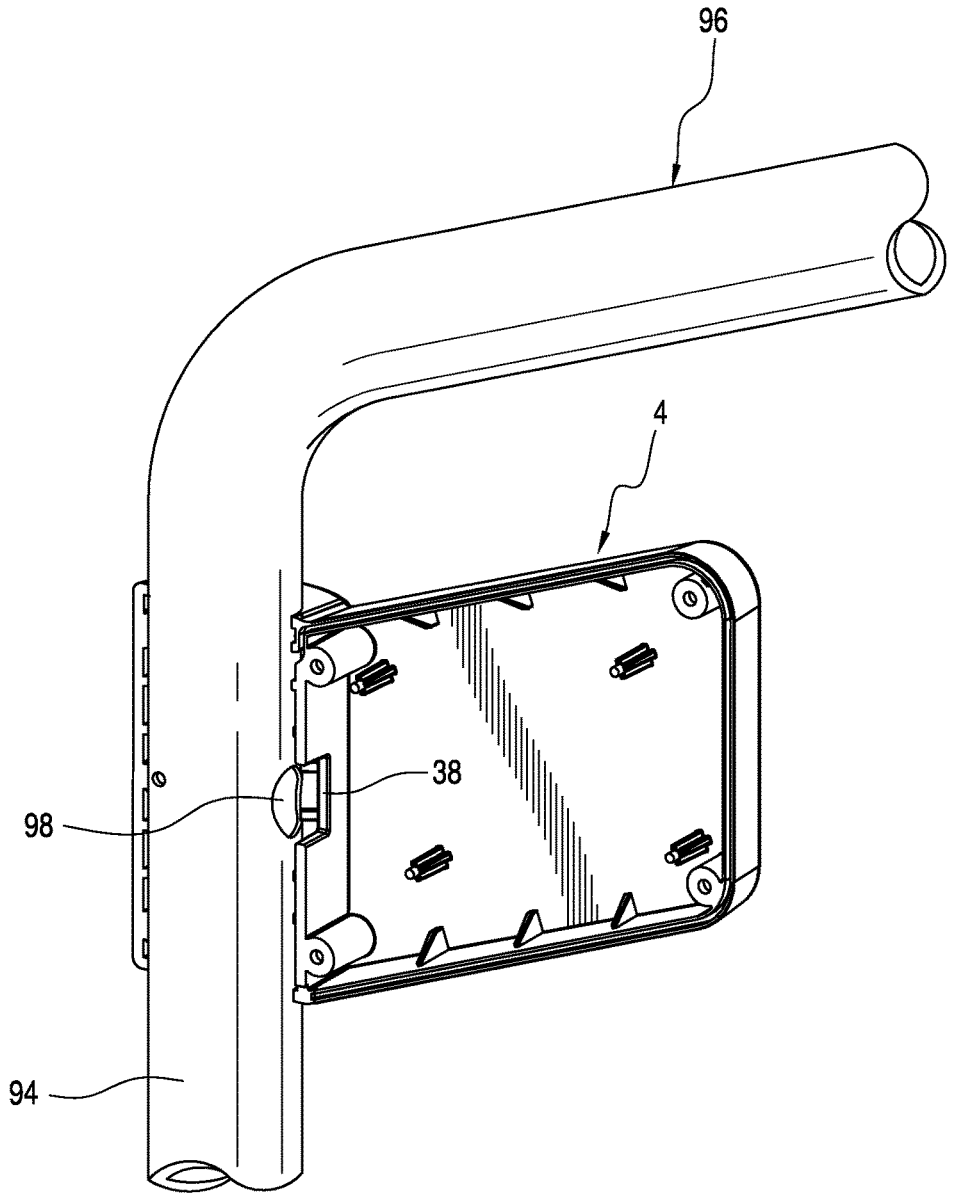
FIG. 12 is a perspective of the left side of the antenna enclosure, with the right side removed, showing attachment to a post of the handrail.

Referring to FIG. 12, the first part 4 is shown being attached to a post 94 of the handrail 96. An opening 98 is aligned with the slot 38 and the slot 40 (see FIG. 4) to allow the antenna cable 44 to pass into the interior of the post 94 and down below for connection to radio equipment.

The antenna enclosure 2 advantageously has a very small form factor, giving it the ability to be placed in smaller handrail configurations and still be able to meet the Americans with Disabilities Act (ADA) guidelines.

The antenna enclosure 2 provides an aesthetically pleasing method of providing wireless propagation solution in a small form factor design that mounts on the handrails throughout a facility, such as a stadium or arena. The enclosure 2 is configured to fit around the diameter of the handrail post while at least a portion of the thickness of the enclosure 2 is less than the diameter of the rail so that it does not protrude out into the area where the public will be walking.

The enclosure 2 can be used within the facility if it has rails where the spacing to place the antenna structure is small such as a P-rail or guard rail. The enclosure 2 is advantageously so compact that is can fit all types of rails within the facilities that are typically used. Further, the use of the spacer sleeve 86 allows mounting of the enclosure 2 over various diameter rails as well.

The enclosure 2 is preferably constructed such that it is UV rated to protect it from the sun and not allow it to become discolored. The enclosure 2 furthermore is IP56 rated for outdoor equipment.

The antenna enclosure 2 uses an antenna radiating element 46 to propagate the RF signal from the antenna to the client (user device) and to receive a RF signal from the client device. The antenna radiator element 46 connects to the radio that provides the wireless signal via coaxial cables.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

We claim:

1. An antenna enclosure for attachment to a handrail, comprising:

a) a first part and a second part, said first and second parts being configured to mate together to form said enclosure;

b) each of said first and second parts including a cavity portion defined by a base wall, a peripheral external side wall and an internal wall, said peripheral external side wall including a top wall, a vertical wall and a bottom wall; said internal wall of respective said first and second parts extending from said top wall to said bottom wall of said peripheral external side wall, said internal wall of respective said first and second parts extending from said base wall of respective said first and second parts; said base wall, said peripheral external side wall and said internal wall of respective said first and second parts being integral to respective said first and second parts;

c) said peripheral external side wall of said first part is configured to mate with said peripheral external side wall of said second part;

d) a seal disposed between said peripheral external side wall of said first part and said peripheral external side wall of said second part to seal said top wall, said vertical wall and said bottom wall of said peripheral external side wall of said first part against said top wall, said vertical wall and said bottom wall of said peripheral external side wall of said second part when said first part and said second part are mated together to form said enclosure;

e) said first and second parts including respective clamp portions integral with respective said internal walls of respective said cavity portions, said clamp portions are configured to wrap around a post of the handrail when said first and second parts are mated together;

f) said clamp portions including respective base walls and rib portions disposed transversely to said base walls of said clamp portions; and g) a first end of each of said rib portions away from respective said cavity portions is oriented downwardly than a second end of each of said respective rib portions proximal to respective said cavity portions.

2. The antenna enclosure as in claim 1, wherein said enclosure is configured to be tilted downwardly toward the post when said first part and said second part are mated together and attached to the post.

3. The antenna enclosure as in claim 1, wherein:

a) said peripheral external side wall of said first part and said peripheral external side wall of said second part include respective opposing edges;

b) one of said opposing edges includes a groove to receive said seal; and c) another of said opposing edges includes a bead configured to be received within said groove to press said seal into said groove.

4. The antenna enclosure as in claim 1, wherein said internal wall of said first part and said internal wall of said second part include respective slots that form an opening when said first part and said second part are mated together.

5. The antenna enclosure as in claim 4, wherein said opening is square.

6. The antenna enclosure as in claim 4, wherein said opening formed by said slots is configured to be spaced from an outside surface of the post when said respective clamp portions are wrapped around the post.

7. The antenna enclosure as in claim 1, wherein said top walls and said bottom walls are configured to be inclined downwardly toward the post when said first and second parts are mated together and attached to the post.

8. The antenna enclosure as in claim 7, wherein said top walls are parallel to said bottom walls.

9. The antenna enclosure as in claim 7, wherein:

a) notches are provided, respectively, at an intersection of said internal wall and said bottom wall of said first part and said second part; and b) said notches form a drain hole when said first part and said second part are mated together.

10. The antenna enclosure as in claim 7, wherein:

a) said top walls include outside surfaces;

b) said clamp portions include upper outside surfaces; and c) said outside surfaces of said top walls and said upper outside surfaces of said clamp portions meet along a rain gutter disposed transversely to said base walls.

11. The antenna enclosure of claim 1, wherein:

a) said base walls of respective said clamp portions include respective opposing edges; and b) said opposing edges are spaced apart from each other to form a gap when said first and second parts are mated together.

12. The antenna enclosure as in claim 11, wherein said gap communicates with said spaces between said rib portions.

13. The antenna enclosure as in claim 1, wherein said rib portions include edges configured to engage the post when said first and second parts are mated together.

14. The antenna enclosure as in claim 13, wherein said edges are complementary to a cross-sectional shape of the post.

15. The antenna enclosure as in claim 1, wherein said first part and said second part include posts extending from respective said base walls configured to position an antenna within said antenna enclosure.

16. The antenna enclosure as in claim 1, wherein:

a) said cavity portion of said first part and said cavity portion of said second part form a chamber for receiving the antenna within said chamber; and b) said chamber is tapered from narrow to wide toward said clamp portions.

17. The antenna enclosure as in claim 16, wherein said base wall of said first part is angled with respect to said base wall of said second part when said first and second parts are mated together.

18. The antenna enclosure as in claim 1, wherein said first and second parts include countersunk holes for attachment screws for securing said first and second parts together.

19. The antenna enclosure as in claim 1, and further comprising a spacer sleeve for said clamp portions.

20. The antenna enclosure as in claim 19, wherein said spacer sleeve is slit longitudinally.

21. An antenna enclosure for attachment to a handrail, comprising:

a) a first part and a second part, said first and second parts being configured to mate together to form said enclosure;

b) each of said first and second parts including a cavity portion defined by a base wall, a peripheral external side wall and an internal wall, said peripheral external side wall including a top wall, a vertical wall and a bottom wall; said internal wall of said first and second parts extending from said top wall to said bottom wall of said peripheral external side wall, said internal wall of said first and second parts extending from said base wall of respective said first and second parts; said base wall, said peripheral external side wall and said internal wall of said first and second parts being integral to respective said first and second parts;

c) said peripheral external side wall of said first part is configured to mate with said peripheral external side wall of said second part;

d) a seal disposed between said peripheral external side wall of said first part and said peripheral external side wall of said second part to seal said top wall, said vertical wall and said bottom wall of said peripheral external side wall of said first part against said top wall, said vertical wall and said bottom wall of said peripheral external side wall of said second part when said first part and said second part are mated together to form said enclosure;

e) said first and second parts including respective clamp portions integral with respective said internal walls of respective said cavity portions, said clamp portions are configured to wrap around a post of the handrail when said first and second parts are mated together;

f) said top walls and said bottom walls are configured to be inclined downwardly toward the post when said first and second parts are mated together and attached to the post;

g) said top walls including outside surfaces;

h) said clamp portions including upper outside surfaces; and i) said outside surfaces of said top walls and said upper outside surfaces of said clamp portions meet along a rain gutter disposed transversely to said base walls.

* * * * *